US006033356A

United States Patent [19]

Mackel et al.

[11] Patent Number: 6,033,356

[45] Date of Patent: Mar. 7, 2000

[54] CENTRIFUGAL DRUM WITH INCREASED FLOW RESISTANCE

[75] Inventors: Wilfried Mackel; Johannes Droste; Ludger Thiemann, all of Oelde, Germany

[73] Assignee: Westfalia Separator AG, Oelde, Germany

[21] Appl. No.: 09/142,675

[22] PCT Filed: Mar. 4, 1997

[86] PCT No.: PCT/DE97/00431

§ 371 Date: Sep. 11, 1998

§ 102(e) Date: Sep. 11, 1998

[87] PCT Pub. No.: WO97/36686

PCT Pub. Date: Oct. 9, 1997

[30] Foreign Application Priority Data

Apr. 2, 1996 [DE] Germany ..... 196 13 215

[51] Int. Cl.[7] ..... B04B 1/08

[52] U.S. Cl. ..... 494/70

[58] Field of Search ..... 494/56, 68–73

[56] References Cited

U.S. PATENT DOCUMENTS

| | | | |
|---|---|---|---|
| 2,294,468 | 9/1942 | Lindgren . | |
| 3,468,475 | 9/1969 | Thylefors | 494/56 |
| 3,741,467 | 6/1973 | Kjellgren | 494/70 |
| 4,695,270 | 9/1987 | Zettier | 494/56 |
| 4,729,759 | 3/1988 | Krook et al. | 494/56 |
| 5,147,280 | 9/1992 | Carlsson et al. | 494/56 |
| 5,160,311 | 11/1992 | Inge et al. | 494/70 |
| 5,779,619 | 7/1998 | Borgstrom et al. | 494/70 |

FOREIGN PATENT DOCUMENTS

| | | |
|---|---|---|
| 36 27 826 | 10/1987 | Germany . |
| 37 16 035 | 12/1988 | Germany . |
| 37 31 229 | 3/1989 | Germany . |

*Primary Examiner*—Charles E. Cooley
*Attorney, Agent, or Firm*—Henry M. Feiereisen

[57] ABSTRACT

A centrifugal drum (1) has an inlet chamber (12) connected to a discharge chamber (10) via ducts (21), with the supplied fluid flowing radially through rib-free annular chambers (24, 25, 26) on the way to the discharge chamber (10). A through-flow resistance is thereby generated which ensures that the inlet chamber (12) is filled completely. Since the ducts (21) start in the vicinity of the inlet pipe (8), the acceleration of the supplied fluid to the speed of rotation of the centrifugal drum (1) occurs over a small diameter with the result that the stress on the centrifuged material is relatively low.

6 Claims, 1 Drawing Sheet

CENTRIFUGAL DRUM WITH INCREASED FLOW RESISTANCE

BACKGROUND OF THE INVENTION

The invention relates to a centrifugal drum with a disk insert and a stationary inlet pipe which extends into an inlet space which rotates with the drum. The inlet space includes an antechamber with ribs and a rib-free inlet chamber. The antechamber and the inlet chamber are connected with each other through an annular gap which is formed between the outside diameter of a disk and a wall of the inlet space. The inlet space is connected by ducts to an outlet chamber for the fluid to be discharged. The inlet chamber can be filled completely due to the throttle effect of the ducts.

A centrifugal drum of this type is known from DE 36 27 826 C2. The throttle effect is produced by a feature where the diameter at which the ducts in the inlet chamber begin, is larger than the diameter of the fluid level in the outlet chamber. This solution requires a relatively high circumferential velocity at the inlet of the ducts which can harm sensitive centrifuged materials, although the fluid is accelerated while the inlet space is completely filled.

SUMMARY OF THE INVENTION

It is an object of the invention to improve the known centrifugal drum and to reduce the mechanical stress on the centrifuged material in the inlet space.

The object is solved by forming ducts which extend radially inwardly close to the inlet pipe, wherein the ribs are shielded from the inlet chamber by a separation wall and wherein the throttle effect is produced by at least one rib-free annular space through which the fluid to be discharged flows in a radial direction.

The rib-free annular space is arranged outside the inlet space. The inlet of the ducts can then be arranged on a relatively small diameter, thereby significantly reducing the mechanical stress on the centrifuged material.

In an advantageous embodiment, the rib-free annular space is arranged on the radially outermost boundary of the ducts which originate from the inlet space. This design is easy to implement.

In another advantageous embodiment, the rib-free annular space is arranged on the periphery of the outlet chamber. At this point, sensitive particles have already been separated out and can therefore no longer adversely affect the process.

The rib-free annular space can also be disposed in the gaps of the disk insert. This feature can be implemented by simply detaching at an appropriate location the spacer bars typically found on the disks.

In another advantageous embodiment, the bottom side of the disk is provided with guide ducts. This feature counteracts a rotation of the fluid in the inlet chamber and provides a large pressure drop between the antechamber and the inlet chamber, thereby generating a relatively high static inlet pressure in the inlet space.

The guide ducts are aligned radially in their center section to prevent the creation of a harmful rotation of the fluid.

The guide ducts may be advantageously aligned in their center section tangentially, opposing the direction of rotation of the centrifugal drum. The resulting fluid rotation counteracts entrainment by elements of the rotating drum.

In still another advantageous embodiment, the guide ducts are closed off by a cover plate. The inside diameter of the cover plate in conjunction with the outside diameter of the inlet pipe forms an annular gap which is connected to the inlet chamber. With this feature, large quantities of fluid can be circulated while at the same time rotation of the liquid in the inlet chamber is almost entirely suppressed.

BRIEF DESCRIPTION OF THE DRAWING

An embodiment of the invention is illustrated in the drawing and is described in greater detail in the following. It is shown in FIG. 1 a cross section through the centrifugal drum, FIG. 2 the section II—II of FIG. 1.

DETAILED DESCRIPTION OF PREFERRED EMBODIMENTS

Figure 1:
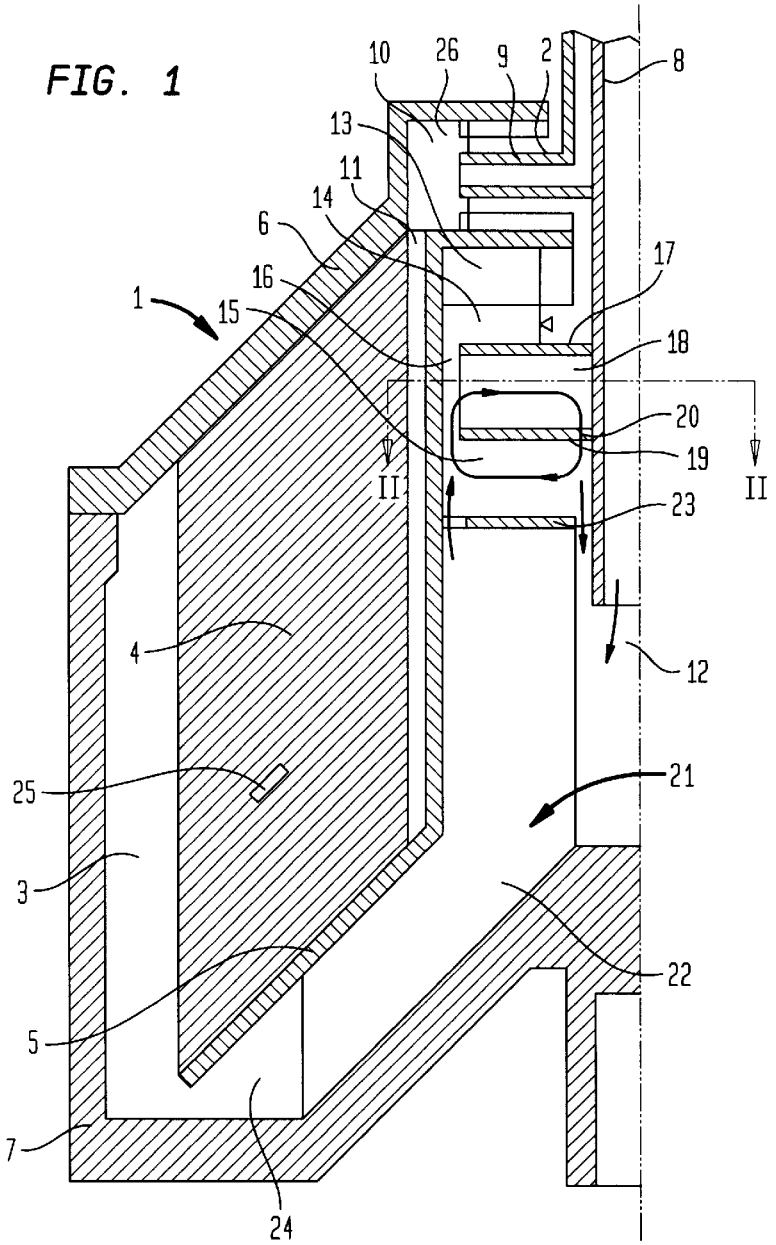

Reference numeral 1 in FIG. 1 refers to the centrifugal drum which includes a separation unit 2 which is located near the inlet and remains stationary during operation. The centrifugal drum 1 has a solid matter space 3 and a separation space which is formed by a disk insert 4 produced from a large number of individual disks. The disk insert 4 is supported by a distribution unit 5. The separation space and the solid matter space are bounded at the top side by a drum cover 6 and the bottom side by a drum jacket 7. A central inlet pipe 8 to which a separation disk 9 which discharges the clarified fluid is secured, is located near the separation unit 2. The separation disk 9 is located in a outlet chamber 10 and is connected to the separation space via discharge ducts 11. The inlet pipe 8 extends into an inlet space 12 which has an antechamber 14 with ribs 13 and a rib-free inlet chamber 15. The chambers 14 and 15 are connected with each other through an annular gap 16 which is formed between the outside diameter of a disk 17 which is attached to the inlet pipe 8, and the inside diameter of the inlet space 12. The bottom side of the disk 17 has guide ducts 18 and is covered with a cover disk 19. The inside diameter of the cover disk 19 together with the outside diameter of the inlet pipe 8 form the annular gap 20. The inlet space 12 is connected to the outlet chamber 10 via ducts 21. The ducts 21 are formed by ribs 22 which extend radially inwardly close to the inlet pipe 8, wherein the ribs 22 are shielded from the inlet chamber 15 by a separation wall 23. Below the distribution unit 5 there is provided a rib-free annular space 24 through which the fluid to be discharged flows in the radial direction. Additional rib-free annular spaces 25, 26 are provided in the gaps of the disk insert 4 and on the periphery of the outlet chamber 10.

The centrifugal fluid is supplied to the inlet space 12 through the inlet pipe 8 and first fills the solid matter space 3 through the ducts 21. The fluid reaches the outlet chamber 10 through the disk insert 4 and the discharge ducts 11 and is discharged from the outlet chamber 10 by the separation disk 9. The rib-free annular spaces 24, 25, 26 increase the flow resistance of the centrifugal drum 1 to such an extent that a static pressure has to be applied when the inlet space 12 is completely filled. Since the inside edges of the ribs 22 are arranged on a smaller diameter, the supplied fluid is subjected to relatively little stress when accelerated to the angular velocity of the centrifugal drum 1. The static pressure which is produced in the inlet space 12 by the supplied fluid, is transmitted to the annular gap 16 through the rib-free inlet chamber 15. This pressure is compensated by the pressure of the rotating fluid in the antechamber 14. Because the rotating separation wall 23 tends to entrain the fluid in the inlet chamber 15, fluid is continuously removed from the periphery of the inlet chamber 15 through the guide ducts 18 and the annular gap 20 and returned to the center of the inlet chamber 15. Depending on the shape of the guide ducts 18, this fluid has either no circumferential velocity at all or a circumferential velocity which opposes the direction of rotation of the centrifugal drum 1. Since the separation wall 23 causes little friction, the fluid is only insignificantly entrained when it flows through the inlet chamber 15.

Figure 2:
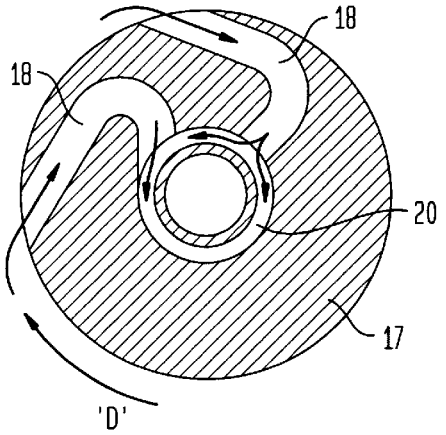

Two alternative embodiments of the guide ducts 18 in the disk 17 are illustrated in FIG. 2. The guide ducts 18 in the center region of the disk 17 can be arranged radially or tangentially so as to oppose the direction of rotation "D" of the centrifugal drum 1.

Other known elements, such as baffles or narrow long friction ducts, can also be used instead of the annular spaces 24, 25, 26 to increase the flow resistance.

What is claimed is:

1. A centrifugal drum, comprising:

a disk insert;

a stationary inlet pipe extending in an inlet space which rotates with the drum and includes an antechamber provided with ribs and a rib-free inlet chamber;

a disk defined by an outside diameter and secured to the inlet pipe, said antechamber and said inlet chamber being connected with each other through an annular first gap formed between the outside diameter of the disk and a confronting wall of the inlet space, wherein the disk has a bottom side provided with guide ducts which are closed off by a cover plate having an inside diameter which in conjunction with an outside diameter of the inlet pipe forms an annular second gap which is connected to the inlet chamber;

passageway means connecting the inlet space with an outlet chamber for discharging fluid, said passageway means including ribs which extend radially inwardly close to the inlet pipe to form ducts;

a separation wall shielding the ribs from the inlet chamber; and at least one rib-free annular space which generates a throttle effect and through which fluid to be discharged flows in a radial direction.

2. The centrifugal drum according to claim 1 wherein the rib-free annular space is disposed on a radially outermost boundary of the ducts extending from the inlet space.

3. The centrifugal drum according to claim 1 wherein the rib-free annular space is disposed on the periphery of the outlet chamber.

4. The centrifugal drum according to claim 1 wherein the rib-free annular space is disposed in gaps of the disk insert.

5. The centrifugal drum according to claim 1 wherein the guide ducts are aligned radially proximate to their center section.

6. The centrifugal drum according to claim 1 wherein the guide ducts are aligned tangentially opposing the direction of rotation of the centrifugal drum.

* * * * *